US010034112B2

(12) United States Patent
Price

(10) Patent No.: US 10,034,112 B2
(45) Date of Patent: Jul. 24, 2018

(54) MASS PORT PLUG FOR CUSTOMIZING HEADPHONE DRIVERS, AND RELATED METHODS

(71) Applicant: Skullcandy, Inc., Park City, UT (US)

(72) Inventor: Rex Price, Santa Monica, CA (US)

(73) Assignee: Skullcandy, Inc., Park City, UT (US)

( * ) Notice: Subject to any disclaimer, the term of this patent is extended or adjusted under 35 U.S.C. 154(b) by 232 days.

(21) Appl. No.: 14/802,360

(22) Filed: Jul. 17, 2015

(65) Prior Publication Data

US 2016/0029137 A1 Jan. 28, 2016

Related U.S. Application Data

(60) Provisional application No. 62/029,393, filed on Jul. 25, 2014.

(51) Int. Cl.
*H04R 31/00* (2006.01)
*H04R 1/22* (2006.01)
(Continued)

(52) U.S. Cl.
CPC ..... *H04R 31/006* (2013.01); *H04R 1/2823* (2013.01); *G10K 2210/1081* (2013.01);
(Continued)

(58) Field of Classification Search
CPC ..... H04R 31/006; H04R 1/2823; H04R 1/22; H04R 1/1008; H04R 1/10; H04R 1/2834;
(Continued)

(56) References Cited

U.S. PATENT DOCUMENTS 3,798,393 A 3/1974 Gorike
4,160,135 A * 7/1979 Gorike ..... H04R 1/2834 381/372
(Continued)

FOREIGN PATENT DOCUMENTS

JP S54-170126 U 12/1979
JP S57-034796 U 2/1982
(Continued)

OTHER PUBLICATIONS

Europe Search Report for European Patent Application No. 15177987.3, dated Oct. 29, 2015, 8 pages.
(Continued)

*Primary Examiner* — Oyesola C Ojo
(74) *Attorney, Agent, or Firm* — TraskBritt

(57) ABSTRACT

A headphone includes an ear-cup housing and an audio driver. The audio driver has a driver housing, and a driver aperture extending through the audio driver from an exterior thereof toward a diaphragm. A mass port plug is disposed at least partially within the driver aperture extending through the audio driver. The mass port plug has an acoustic aperture extending through the mass port plug from a first side thereof to an opposing second side thereof, and the acoustic aperture is configured to cause the audio driver to exhibit a selected detectable sound pressure level (SPL) profile. Methods of fabricating headphones include insertion of such a mass port plug into a driver aperture extending through an audio driver. The mass port plugs and methods may be used to adapt substantially identical audio drivers for use in ear-cup housings having differing configurations while providing selected detectable sound pressure level profiles.

20 Claims, 9 Drawing Sheets

(51) Int. Cl.
*H04R 1/10* (2006.01)
*H04R 5/033* (2006.01)
*H04R 1/28* (2006.01)

(52) U.S. Cl.
CPC ..... *H04R 1/1008* (2013.01); *H04R 1/1075* (2013.01); *H04R 1/1083* (2013.01); *H04R 1/22* (2013.01); *H04R 1/2846* (2013.01); *H04R 5/033* (2013.01)

(58) Field of Classification Search
CPC .... H04R 1/1083; H04R 5/033; H04R 1/2846; H04R 1/1075; G10K 2210/1081
See application file for complete search history.

(56) References Cited

U.S. PATENT DOCUMENTS 4,981,194 A * 1/1991 Kamon ..... H04R 1/08 181/129
7,391,878 B2 * 6/2008 Liao ..... H04R 5/033 381/370
7,634,099 B2 * 12/2009 Harvey ..... H04R 1/2819 381/328
8,199,955 B2 * 6/2012 Akino ..... H04R 1/1008 381/332
8,442,258 B2 5/2013 Kimura
9,301,040 B2 * 3/2016 Annunziato ..... H04R 1/1058
9,525,929 B2 * 12/2016 Burgett ..... H04R 1/1041
2002/0015501 A1 * 2/2002 Sapiejewski ..... H04R 1/1083 381/71.6
2007/0223718 A1 9/2007 Felder et al.
2008/0170710 A1 * 7/2008 Pasternak ..... H04R 1/2849 381/74
2008/0226114 A1 * 9/2008 Thompson ..... H04R 1/1016 381/380
2011/0176701 A1 * 7/2011 Collins ..... H04R 1/2819 381/386
2011/0188696 A1 * 8/2011 Kimura ..... H04R 1/10 381/378
2012/0114160 A1 * 5/2012 Lin ..... H04R 1/1091 381/380
2013/0343593 A1 * 12/2013 Howes ..... H04R 1/1016 381/380
2014/0294223 A1 * 10/2014 Sapiejewski ..... H04R 1/1058 381/372
2015/0280677 A1 * 10/2015 Hui ..... H03G 7/007 381/57
2016/0192065 A1 * 6/2016 Oosato ..... H04R 1/2826 381/378

FOREIGN PATENT DOCUMENTS

JP H02-294198 A 12/1990
WO 2008064022 A2 2/2007
WO 2007018657 A2 5/2008

OTHER PUBLICATIONS

European Office Action for European Application No. 15177987.3 dated Oct. 13, 2017, 7 pages.

* cited by examiner

MASS PORT PLUG FOR CUSTOMIZING HEADPHONE DRIVERS, AND RELATED METHODS

CROSS-REFERENCE TO RELATED APPLICATION

This application claims the benefit of U.S. Provisional Patent Application Ser. No. 62/029,393, filed Jul. 25, 2014, the disclosure of which is hereby incorporated herein in its entirety by this reference.

FIELD

Embodiments of the disclosure generally relate to headphones, to audio drivers and audio driver assemblies for use in headphones, and to methods of making such headphones, audio drivers, and assemblies.

BACKGROUND

Conventional headphones include one or two speaker assemblies, each having an audio driver that produces audible sound waves using a magnet, coil, and diaphragm. Each speaker assembly is mounted in an ear-cup housing, and a foam or other soft material is provided on the side of the ear-cup housing that will abut against the ear and/or head of a person wearing the headphone. The positive and negative electrical terminals for the audio driver are respectively soldered to ends of wires, which extend to an audio jack (e.g., a tip-sleeve (TS) connector, a tip-ring-sleeve (TRS) connector, a tip-ring-ring-sleeve (TRRS) connector, etc.). The audio jack may be coupled to a media player such as a mobile phone, a digital media player, a computer, a television, etc., and the audio signal is transmitted to the audio driver in the speaker assembly within the headphone through the wires. Thus, the audio driver is permanently installed within the headphone, and is not configured to be removed without destructing the permanent solder coupling of the wires to the terminals of the audio driver.

The acoustic performance of a headphone is conventionally a function of both the audio driver, as well as the configuration of the speaker assembly and the ear-cup housing within which the driver is disposed. The speaker assembly and the ear-cup housing of conventional headphones typically define acoustical cavities that affect the acoustics of the headphone. Thus, the manufacturer of the headphones may design the ear-cup housing and speaker assembly of a headphone, for use with a selected audio driver, so as to provide the headphone with acoustics deemed desirable by the manufacturer.

BRIEF SUMMARY

In some embodiments, the present disclosure includes a headphone having an ear-cup housing and an audio driver disposed at least partially within the ear cup housing. The audio driver includes driver housing and a diaphragm suspended from the driver housing. One of a magnet and a coil is carried on a back side of the diaphragm, and another of the magnet and the coil is carried by the driver housing behind the diaphragm. The magnet and coil are magnetically coupled with one another such that electrical current flowing through the coil generates a magnetic force acting on the diaphragm through the magnet or coil carried on the back side of the diaphragm. A driver aperture extends through the audio driver from an exterior thereof toward the diaphragm.

A mass port plug is disposed at least partially within the driver aperture extending through the audio driver. The mass port plug has an acoustic aperture extending through the mass port plug from a first side thereof to an opposing second side thereof. The acoustic aperture is configured to cause the audio driver to exhibit a selected detectable sound pressure level (SPL) profile. For example, the acoustic aperture may have a cross-sectional area and length configured to cause the audio driver to exhibit a selected detectable SPL profile.

In additional embodiments, the present disclosure includes a method of fabricating a headphone. An audio driver is provided that includes a driver housing, a diaphragm suspended from the driver housing, one of a magnet and a coil carried by the diaphragm, another of the magnet and the coil carried by the driver housing, and a driver aperture extending through the audio driver from an exterior thereof toward the diaphragm. A mass port plug is inserted at least partially into the driver aperture extending through the audio driver. The mass port plug has an acoustic aperture extending through the mass port plug from a first side thereof to an opposing second side thereof. The acoustic aperture is configured to cause the audio driver to exhibit a selected detectable SPL profile. For example, the acoustic aperture may have a cross-sectional area and length configured to cause the audio driver to exhibit a selected detectable SPL profile. The audio driver is attached to an ear-cup housing.

In yet further embodiments, the present disclosure includes a method of fabricating a plurality of headphones. A plurality of at least substantially identical audio drivers are provided, each of which includes a driver housing, a diaphragm suspended from the driver housing, one of a magnet and a coil carried by the diaphragm, another of the magnet and the coil carried by the driver housing, and a driver aperture extending through the audio driver from an exterior thereof toward the diaphragm. Mass port plugs of a first plurality of mass port plugs are inserted at least partially into the driver apertures extending through some of the audio drivers. Each of the mass port plugs of the first plurality has an acoustic aperture extending through the mass port plug from a first side thereof to an opposing second side thereof, the acoustic aperture configured to cause the audio drivers to exhibit a first selected detectable SPL profile. Mass port plugs of a second plurality of mass port plugs are inserted at least partially into the driver apertures extending through others of the audio drivers. Each of the mass port plugs of the second plurality have an acoustic aperture extending through the mass port plug from a first side thereof to an opposing second side thereof, the acoustic aperture configured to cause the audio drivers to exhibit a second selected driver detectable SPL profile. The mass port plugs of the first plurality have a configuration different from a configuration of the mass port plugs of the second plurality. The audio drivers are attached to ear-cup housings.

BRIEF DESCRIPTION OF THE DRAWINGS

The present disclosure may be understood more fully by reference to the following detailed description of example embodiments, which are illustrated in the accompanying figures in which.

DETAILED DESCRIPTION

The illustrations presented herein are not meant to be actual views of any particular headphone, speaker assembly, driver unit, or component thereof, but are merely simplified schematic representations employed to describe illustrative embodiments. Thus, the drawings are not necessarily to scale.

As used herein, the term "media player" means and includes any device or system capable of producing an audio signal and wired or wirelessly connectable to a speaker to convert the audio signal to audible sound. For example and without limitation, media players include portable digital music players, portable compact disc players, portable cassette players, mobile phones, smartphones, personal digital assistants (PDAs), radios (e.g., AM, FM, HD, and satellite radios), televisions, ebook readers, portable gaming systems, portable DVD players, laptop computers, tablet computers, desktop computers, stereo systems, and other devices or systems that may be created hereafter.

As used herein, the term "emitted sound pressure level (SPL) profile" means and includes sound pressure levels over a range of frequencies, as measured in dB (SPL) per 1 mW, of audio signals as emitted by a sound source (e.g., an audio driver or a headphone including an audio driver).

As used herein, the term "detectable sound pressure level (SPL) profile" means and includes sound pressure levels over a range of frequencies of audio signals as detectable or detected by a user of an audio device, such as an audio driver or a headphone including an audio driver, as measured in dB (SPL) per 1 mW. Detectable SPL profiles may be measured using commercially available testing equipment and software. For example, detectable SPL profiles may be obtained using, for example, the Head and Torso Simulator ("HATS") Type 4128C and Ear Part Number 4158-C commercially available from Brüel & Kjær Sound & Vibration Measurement A/S of Nærum, Denmark, in conjunction with sound test and measurement software, such as Soundcheck 10.1, which is commercially available from Listen, Inc. of Boston, Mass.

Figure 1A:
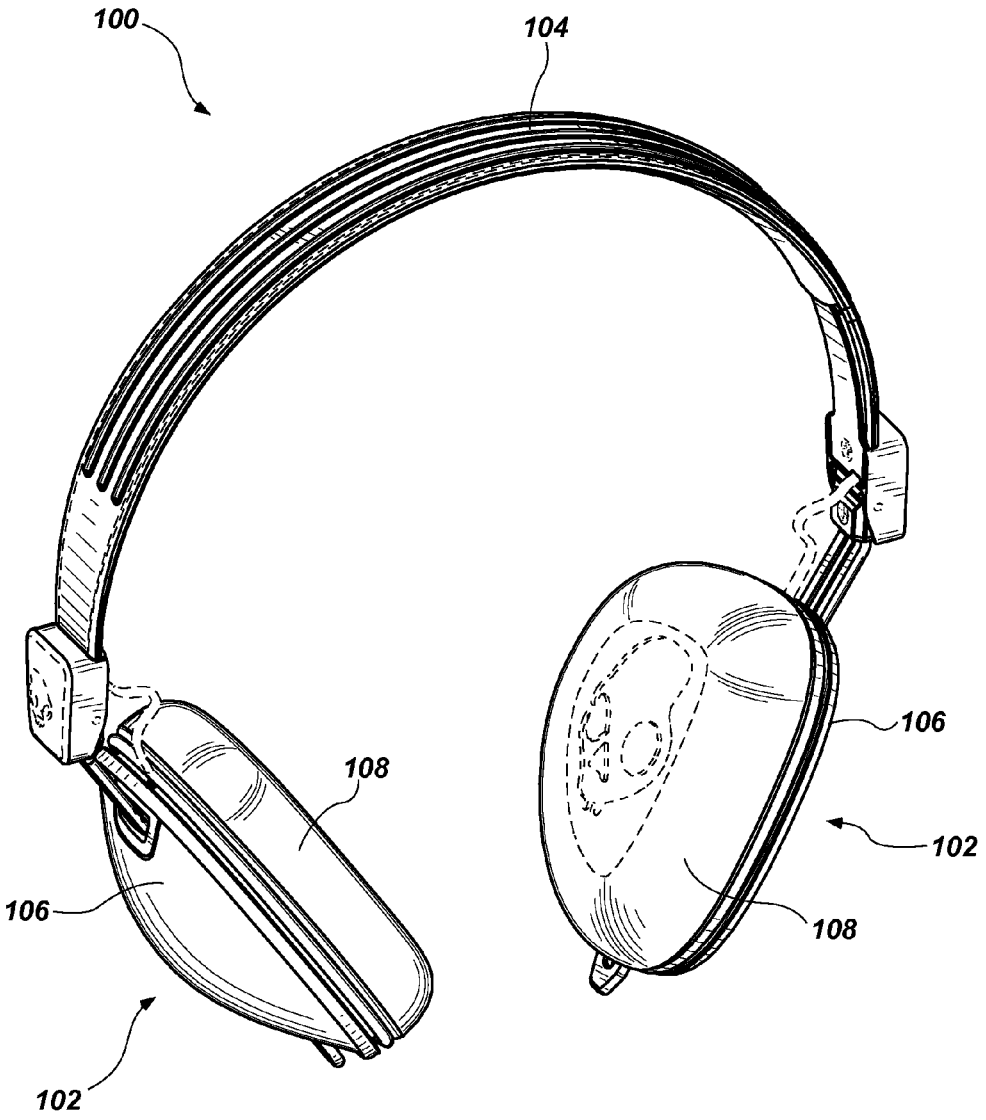
FIG. 1A is a perspective view of an embodiment of a headphone of the present disclosure.

FIG. 1A is a perspective view of a headphone 100 that includes a tunable audio driver, as discussed in further detail below. The headphone 100 has two ear-cup assemblies 102 that are connected with a headband 104, which rests on the head of the user and supports the ear-cup assemblies 102 over or on the ears of the user. Each ear-cup assembly 102 includes an outer ear-cup housing 106, and may include a cushion 108 attached to or otherwise carried on the outer ear-cup housing 106. The headphone 100 may be configured to receive an electronic audio signal from a media player, either through a wired connection or a wireless connection between the headphone 100 and media player.

Figure 1B:
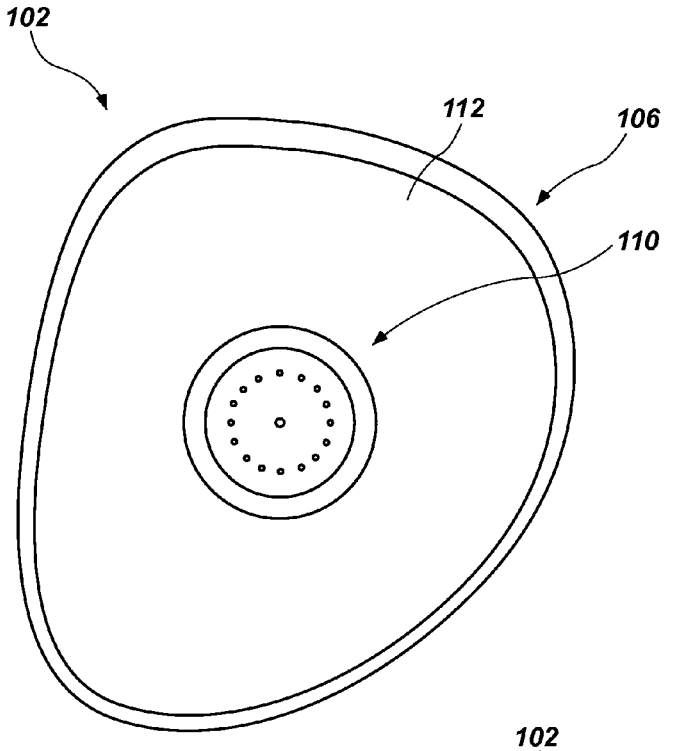
FIG. 1B is a cross-sectional view of an ear-cup assembly of the headphone of FIG. 1A showing an audio driver disposed therein including a customizable mass port plug for tuning a detectable sound pressure level profile of the audio driver and the headphone.
Figure 1C:
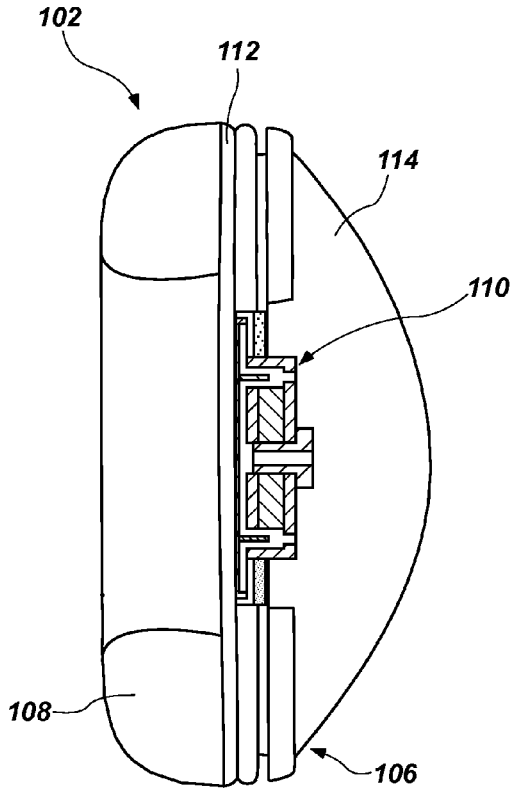
FIG. 1C is a cross-sectional view of the ear-cup assembly of FIG. 1B in a plane transverse to the plane of view of FIG. 1B, and further illustrates the audio driver within the ear-cup assembly.

FIGS. 1B and 1C illustrate an audio driver 110 within one of the ear-cup assemblies 102. As shown in FIG. 1C, the outer ear-cup housing 106 may include two or more members that are assembled together around the audio driver 110. As a non-limiting example, the outer ear-cup housing 106 may include a front member 112 and a back member 114. The various members of the outer ear-cup housing 106 may be formed from, for example, plastic or metal, and may serve as a frame structure for the ear-cup assembly 102.

In accordance with embodiments of the present disclosure, the audio driver 110 may include a mass port plug 166 (FIG. 3), as described in further detail below, which may be used to configure the audio driver 110 and, hence, the headphone 100, to exhibit a selected dateable SPL profile. In other words, the mass port plug may be used to selectively tune the acoustic response of the audio driver 110 and the headphone 100.

Figure 2:
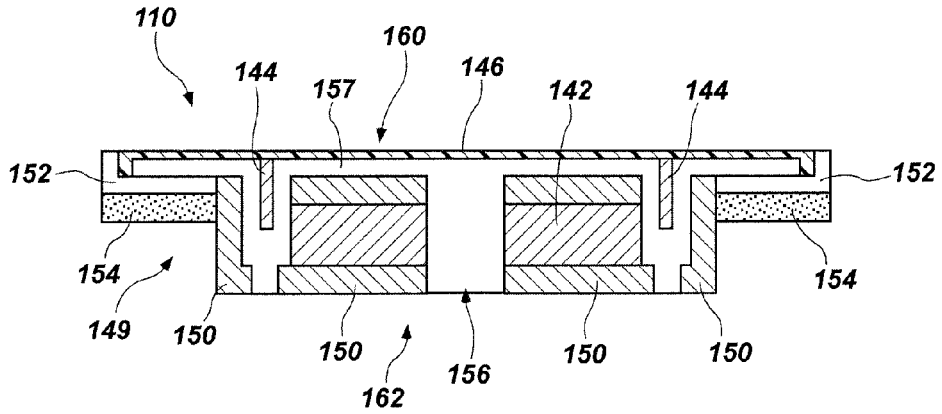
FIG. 2 is a simplified cross-sectional side view illustrating the audio driver of the headphone of FIGS. 1A-1C, without the mass port plug disposed therein.

FIG. 2 illustrates the audio driver 110 of FIGS. 1A-1C separate from the headphone 100 and other components of the ear-cup assembly 102, and without the mass port plug 166 (FIG. 3) inserted therein. Many configurations of audio drivers are known in the art, any of which may be adapted for use in embodiments of the present disclosure. FIG. 2 illustrates just one non-limiting example of such an audio driver 110.

The audio driver 110 includes a driver housing 149, a diaphragm 146 suspended from the driver housing 149, one of a magnet 142 and a coil 144 carried on a back side of the diaphragm 146, and the other of the magnet 142 and the coil 144 carried by the driver housing 149 behind the diaphragm 146. The magnet 142 and the coil 144 are magnetically coupled with one another such that electrical current flowing through the coil 144 generates a magnetic force acting on the diaphragm 146. A driver aperture 156 extends through the audio driver 110 from an exterior thereof toward the diaphragm 146.

In some embodiments, the driver housing 149 may include one or more components assembled together to form the driver housing 149. For example, in the illustrated embodiment, the driver housing 149 includes a yoke cup 150, a driver basket 152, and a printed circuit board 154.

As shown in FIG. 2, the magnet 142 may be or include a permanent magnet 142 and the coil 144 may be positioned so as to circumscribe the permanent magnet 142. In this illustrated embodiment, the coil 144 is attached to a back side of the flexible diaphragm 146 within the audio driver 110, and the permanent magnet 142 is supported within the yoke cup 150 of the driver housing 149. The yoke cup 150 of conventional audio drivers often comprises a metal. The driver basket 152, which may comprise a polymeric structure, may be attached to the yoke cup 150, and the flexible diaphragm 146 may be attached to and suspended from the driver basket 152. The coil 144 may be electrically coupled to conductive terminals of the audio driver 110. In other embodiments, the positions of the permanent magnet 142 and the coil 144 may be reversed.

The diaphragm 146 is positioned on a front side 160 of the audio driver 110, and the yoke cup 150 is disposed on a back side 162 of the audio driver 110.

The printed circuit board 154 may be attached to the driver basket 152, and electrical conductors and/or components of the audio driver 110 (such as the conductive terminals for the audio driver 110) may be disposed on the printed circuit board 154. As shown in FIG. 2, the driver aperture 156 may extend through the yoke cup 150 and/or the permanent magnet 142 to provide an opening between a space 157 within the audio driver 110 (which may define an acoustic cavity within the audio driver 110) between the diaphragm 146 and the magnet 142 and an exterior of the audio driver 110. The driver aperture 156 may be defined by surfaces of one or more of the driver housing 149 (e.g., one or more surfaces of the yoke cup 150, driver basket 152, and/or printed circuit board 154), the magnet 142, and the coil 144, depending upon the configuration of the audio driver 110.

During operation, current is caused to flow through the coil 144, the magnitude of which fluctuates according to the electrical signal carried by the current. The interaction between the magnetic field of the permanent magnet 142 and the fluctuating magnetic field generated by the current flowing through the coil 144, results in vibration of the flexible diaphragm 146, resulting in audible sound being emitted therefrom.

Figure 3:
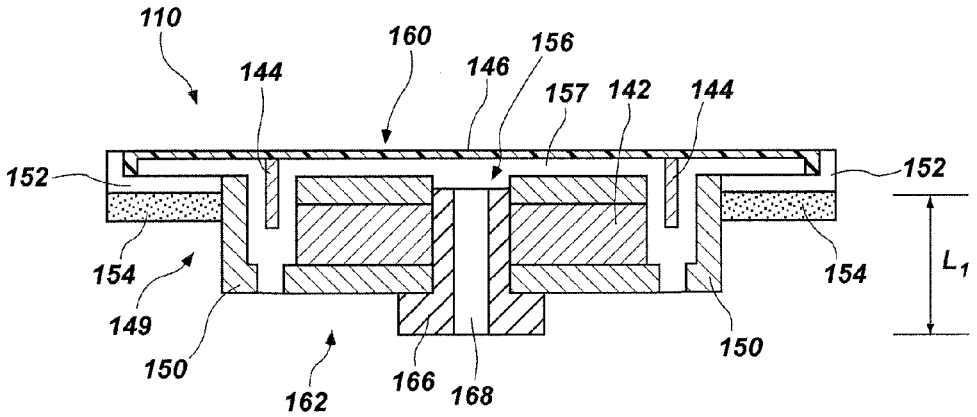
FIG. 3 is a simplified cross-sectional side view illustrating the audio driver of the headphone of FIGS. 1A-1C, with a first embodiment of a mass port plug disposed therein.

Referring to FIG. 3, as previously mentioned, in accordance with embodiments of the disclosure, the audio driver of a headphone, such as the audio driver 110 of the headphone 100 of FIGS. 1A-1C, may include a mass port plug 166 on the back side 162 of the audio driver 110. The mass port plug 166 is disposed at least partially within the driver aperture 156 extending through the audio driver 110. The mass port plug 166 has an acoustic aperture 168 extending through the mass port plug 166 from a first side thereof to an opposing second side thereof. Thus, the mass port plug 166 acoustically couples the exterior of the audio driver 110 with the acoustical cavity defined within the driver housing 149 of the audio driver 110. The size and shape of the acoustic aperture 168 may be configured to cause the audio driver 110 to exhibit a selected detectable SPL profile.

The mass port plug 166 may be directly coupled to the audio driver 110 using, for example, an adhesive, a snap-fit, a welding process, or any other suitable method. In some embodiments, the mass port plug 166 may have a laterally extending flange configured to abut against the outer surface of the driver housing 149 on the back side 162 of the audio driver 110, as shown in FIG. 3.

A damping material optionally may be provided within the acoustic aperture 168 of the mass port plug 166, so as to selectively adjust the emitted SPL profile and/or the detectable SPL profile of the audio driver 110 and headphone 100. The damping material may comprise, for example, a woven or non-woven material (e.g., a textile or paper) or a polymeric foam (open or closed cell) material.

As previously mentioned, the mass port plug 166 may be used to tune the acoustic response of the audio driver 110. The mass port plug 166 may include one or more acoustic apertures 168 extending therethrough, and the one or more acoustic apertures 168 may have a cross-sectional area and length configured to cause the audio driver 110 to exhibit a selected detectable SPL profile. In the embodiment shown in FIG. 3, the mass port plug 166 includes a single, cylindrical acoustic aperture 168 extending through the mass port plug 166 between opposing sides thereof. The mass port plug 166 has a length $L_1$ and a cross-sectional area $A_1$ in the plane transverse to the length $L_1$ (see FIG. 5B).

The dimensions and configuration (e.g., the length and cross-sectional area) of the acoustic aperture 168 will affect the acoustic response of the driver assembly 110. Thus, by using mass port plugs 166 having different configurations and acoustic apertures of different shapes and dimensions, the audio driver 110 may be selectively tuned to have different selected detectable SPL profiles.

Figure 4:
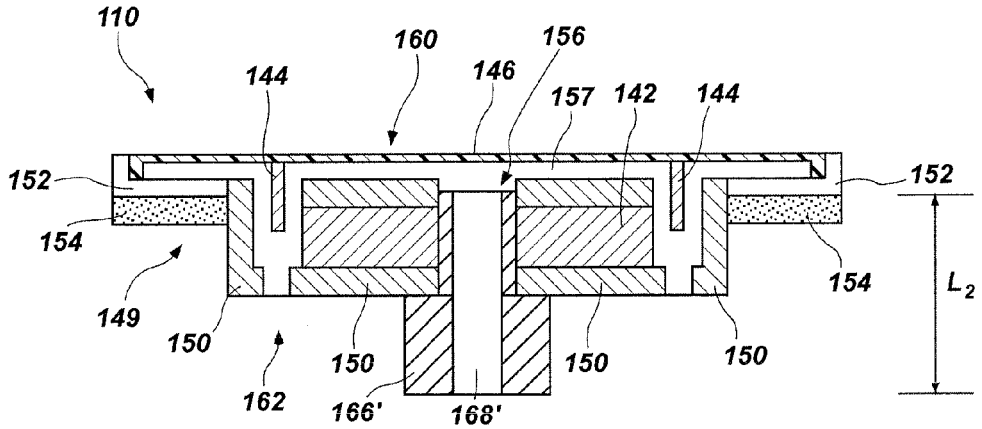
FIG. 4 is a simplified cross-sectional side view illustrating the audio driver of the headphone of FIGS. 1A-1C, with a second embodiment of a mass port plug disposed therein.

For example, FIG. 4 illustrates the audio driver 110 with another embodiment of a mass port plug 166', which has a configuration similar to, but different from the configuration of the mass port plug 166 of FIG. 3. In particular, while the mass port plug 166' also has a single, cylindrical acoustic aperture 168', the acoustic aperture 168' has a length $L_2$ that is longer than the length $L_1$ of the acoustic aperture 168 of the mass port plug 166 of FIG. 3. Similarly, the acoustic aperture 168' has a cross-sectional area $A_2$ that is greater than the cross-sectional area $A_1$ of the acoustic aperture 168 of the mass port plug 166 of FIG. 3. As a result, the audio driver 110 shown in FIG. 4 will exhibit a different detectable SPL profile relative to the audio driver 110 of FIG. 3.

Figure 5A:
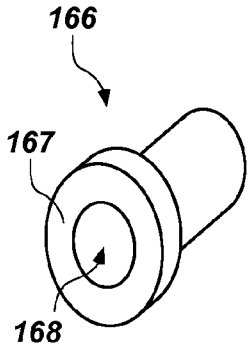
FIG. 5A is a side view of an embodiment of a mass port plug as described herein.
Figure 5B:
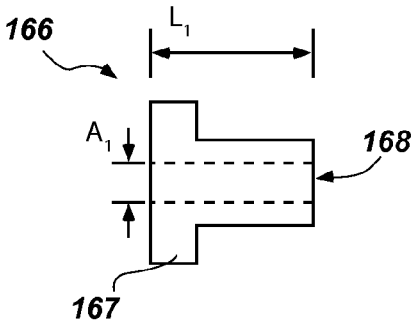
FIG. 5B is a first end view of the mass port plug of FIG. 5A.
Figure 5C:
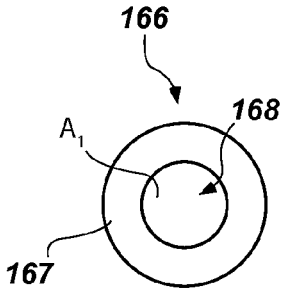
FIG. 5C is a second end view of the mass port plug of FIGS. 5A and 5B.

FIGS. 5A through 5C illustrate the mass port plug 166 of FIG. 3 separate from the audio driver 110, and illustrate the cross-sectional area $A_1$ and the length $L_1$ of the acoustic aperture 168 extending therethrough. As shown therein, in some embodiments, the mass port plug 166 may be generally tubular, and may be generally cylindrical. In some embodiments, the mass port plug 166 may further include a radially extending flange 167 that is configured to abut against one or more surfaces of other components of the audio driver 110, such as a surface of the driver housing 149. The flange 167 may be used to ensure that the plug 166 is correctly positioned within the audio driver 110.

The mass port plug 166 may comprise a polymer or a metal material, and may be fabricated using any of a number of known processes, including, for example, molding, stamping, forging, machining, etc.

Figure 6:
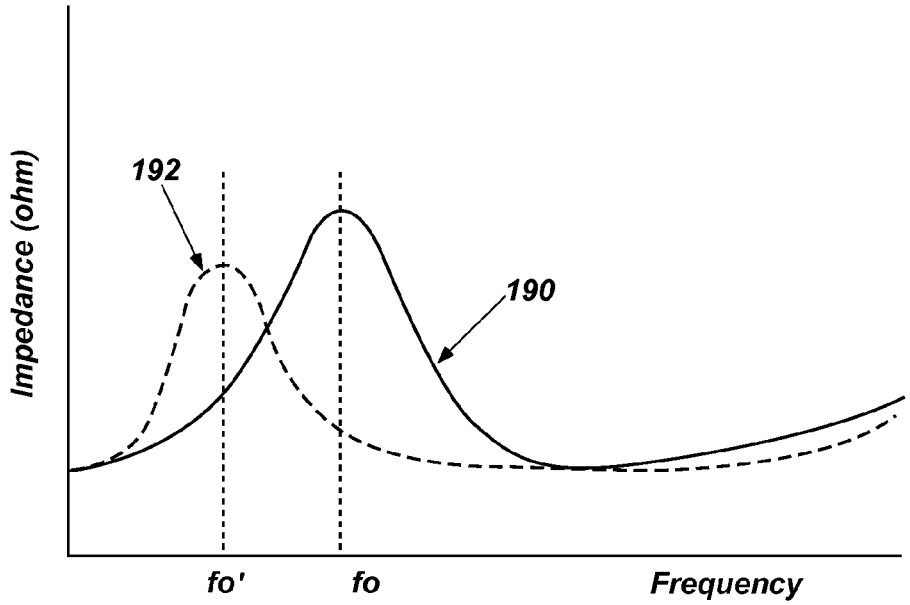
FIG. 6 is a simplified graph illustrating how a mass port plug, such as those shown in FIGS. 3, 4, and 5A-5C, may affect the free-air electrical impedance response of an audio driver to which it may be attached.
Figure 7:
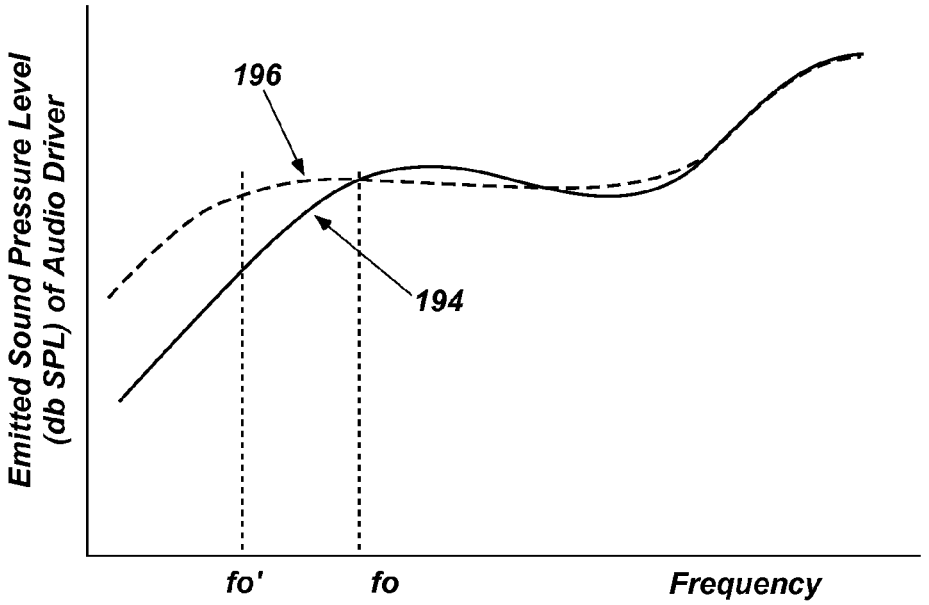
FIG. 7 is a simplified graph illustrating how a mass port plug, such as those shown in FIGS. 3, 4, and 5A-5C, may affect an emitted SPL profile of an audio driver to which it may be attached.
Figure 8:
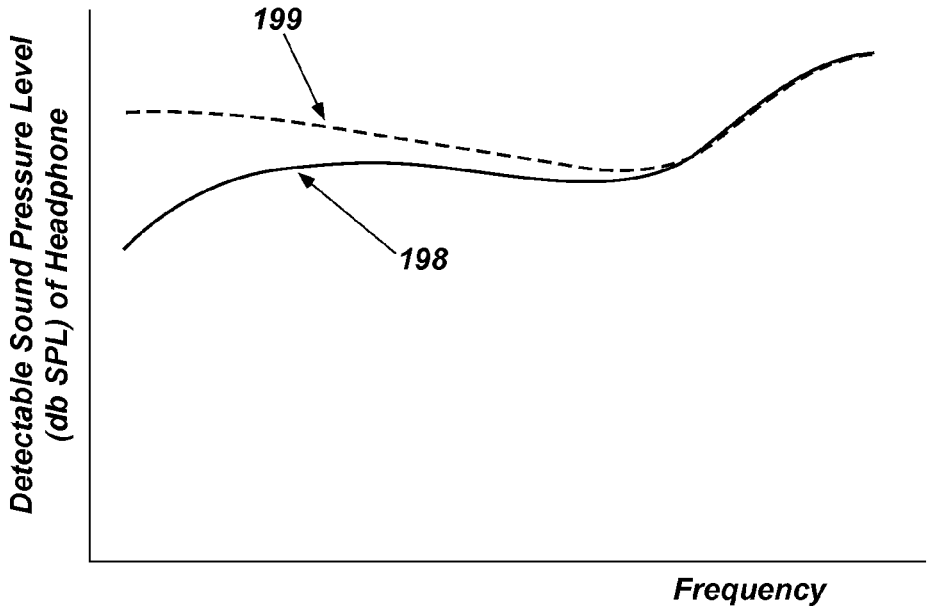
FIG. 8 is a simplified graph illustrating how a mass port plug, such as those shown in FIGS. 3, 4, and 5A-5C, may affect an emitted SPL profile of a headphone including an audio driver to which the mass port plug may be attached.

FIGS. 6 through 8 are graphs illustrating how the presence of mass port plugs 166 of different configurations as described herein may affect the acoustic response of the audio driver 110 and/or the headphone 100.

Line 190 in FIG. 6 represents how the electrical impedance of the audio driver 110 as a function of frequency may appear when measured in the absence of a mass port plug 166, while line 192 in FIG. 6 represents how the electrical impedance of the audio driver 110 as a function of frequency may appear when measured with the mass port plug 166 secured to the audio driver 110 at least partially within the driver aperture 156 in the driver housing 149 on the back side 162 thereof, as described above. As shown in FIG. 6, the peak frequency $f_0$ may be shifted to a relatively lower frequency $f_{0'}$ when the mass port plug 166 is secured to the audio driver 110 over the back side 162 thereof.

Line 194 in FIG. 7 represents how the emitted SPL profile of the audio driver 110 may appear when measured in the absence of a mass port plug 166, while line 196 in FIG. 7 represents how the emitted SPL profile of the audio driver 110 may appear when measured with the mass port plug 166 secured to the audio driver 110 as described above. As shown in FIG. 7, the sound pressure level of at least some frequencies may be increased, and particularly over low (bass) frequencies (e.g., frequencies of about 16 Hz to approximately 512 Hz), when the mass port plug 166 is secured to the audio driver 110 over the back side 162 thereof, compared to the audio driver 110 in the absence of the mass port plug 166.

Line 198 in FIG. 8 represents how the detectable SPL profile of the headphone 100 may appear when measured in the absence of a mass port plug 166 on the audio driver 110, while line 199 in FIG. 8 represents how the detectable SPL profile of the headphone may appear when measured with the mass port plug 166 secured to the audio driver 110 as described above. As shown in FIG. 8, the sound pressure level of at least some frequencies may be increased, and particularly over low (bass) frequencies (e.g., frequencies of about 16 Hz to approximately 512 Hz), when the mass port plug 166 is secured to the audio driver 110 as described herein, compared to the audio driver 110 in the absence of the mass port plug 166.

Additional embodiments of the disclosure include driver assemblies for use in headphones that are configured such that a port of a driver unit of the driver assembly is open to an exterior of a headphone in which it is to be received without communicating acoustically with any volume outside the driver assembly within the outer ear-cup housing of the headphone. In other words, the ear-cup housing of the headphone may not define any acoustical cavity affecting the detectable SPL profile of the headphone 100 in any appreciable manner.

Figure 9A:
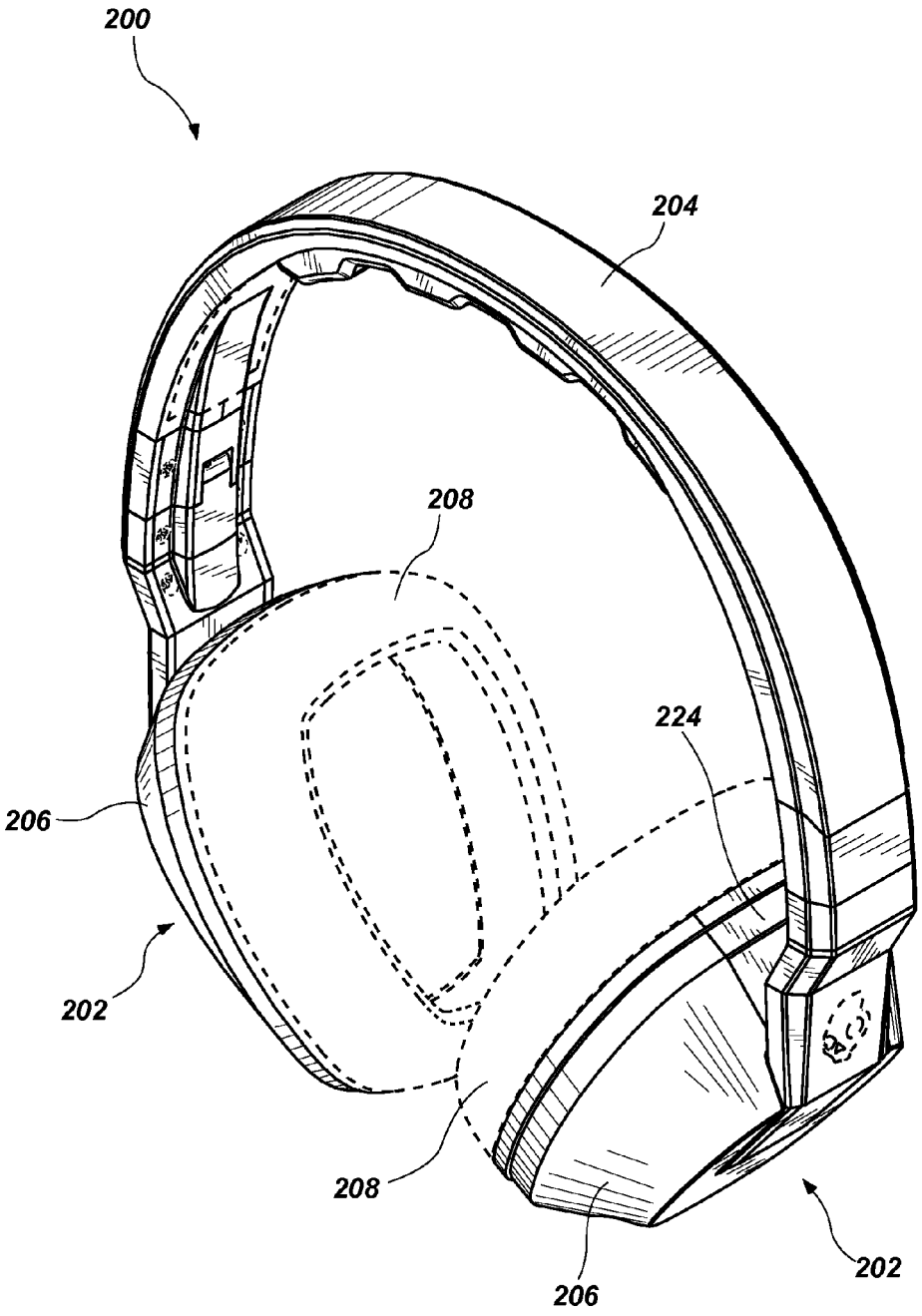
FIG. 9A is a perspective view of an embodiment of a headphone of the present disclosure that includes an audio driver as described herein.

For example, FIG. 9A illustrates an additional embodiment of a headphone 200 of the present disclosure. The headphone 200 is similar to the headphone 100 previously described with reference to FIGS. 1A through 1C, and includes two ear-cup assemblies 202 that are connected with a headband 204, which rests on the head of the user and supports the ear-cup assemblies 202 over or on the ears of the user. Each ear-cup assembly 202 includes an outer ear-cup housing 206, and may include a cushion 208 attached to or otherwise carried on the outer ear-cup housing 206. The headphone 200 may be configured to receive an electronic audio signal from a media player, either through a wired connection or a wireless connection between the headphone 200 and media player.

Figure 9B:
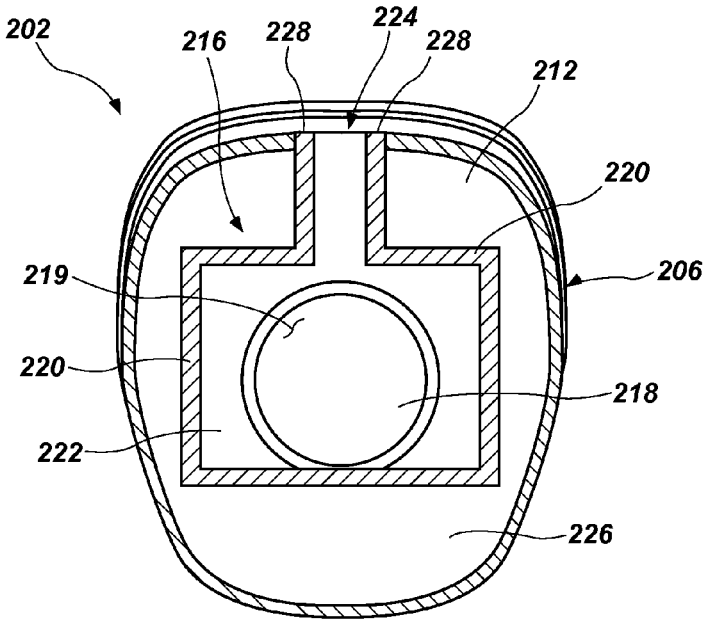
FIG. 9B is a simplified and schematic illustration of a cross-sectional view of an ear-cup assembly of the headphone of FIG. 9A.
Figure 9C:
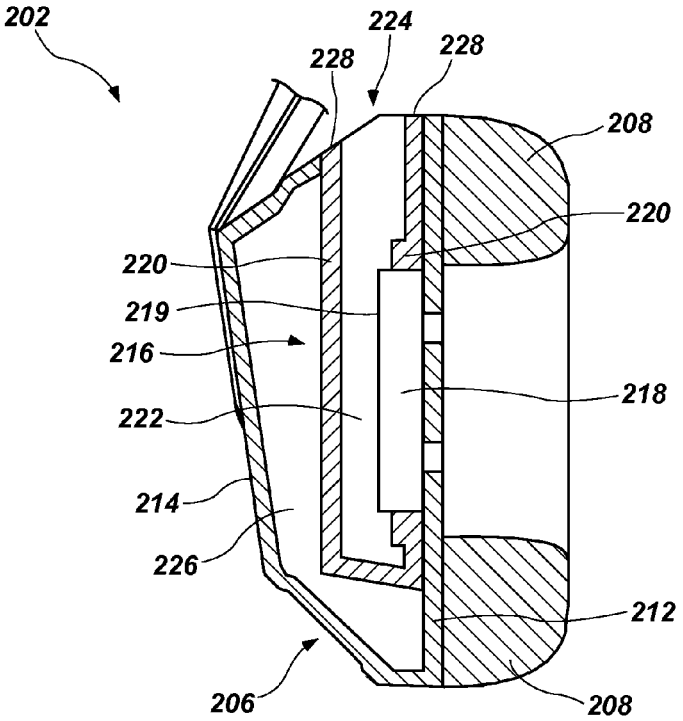
FIG. 9C is a cross-sectional view of the ear-cup assembly of FIG. 9B in a plane transverse to the plane of view of FIG. 9B.

FIGS. 9B and 9C are simplified representations of cross-sectional views of one of the ear-cup assemblies 202 of the headphone 200 of FIG. 9A. As shown in FIGS. 9B and 9C, the outer ear-cup housing 206 may include two or more members that are assembled together to form the outer ear-cup housing 206. As a non-limiting example, the outer ear-cup housing 206 may include a front member 212 and a back member 214. The various members of the outer ear-cup housing 206 may be formed from, for example, plastic or metal, and may serve as a frame structure for the ear-cup assembly 202.

In accordance with some embodiments of the present disclosure, the ear-cup assembly 202 includes a driver assembly 216. The driver assembly 216 includes an audio driver 218 secured within a driver unit housing 220. The driver unit housing 220 defines an acoustical cavity 222 between the driver unit housing 220 and the audio driver 218. In other words, the driver unit housing 220 may comprise an enclosure in which the audio driver 218 may be disposed within the ear-cup assembly 202. The driver unit housing 220 has a port 224 extending through the driver unit housing 220 between the acoustical cavity 222 and the exterior of the driver assembly 216. Moreover, the driver unit housing 220 is configured to be secured within the outer ear-cup housing 206 of the ear-cup assembly 202 of the headphone 200 such that the port 224 in the driver unit housing 220 is open to the exterior of the headphone 200 without communicating acoustically with any volume outside the driver assembly 216 within the outer ear-cup housing 206 of the headphone 200, such as the volume of space 226 within the outer ear-cup housing 206 that is outside the driver assembly 216. In this configuration, the acoustical cavity 222 is defined between the driver unit housing 220 and a back side 219 of the audio driver 218.

The audio driver 218 may comprise an audio driver 110 as previously described herein. For example, in some embodiments, the audio driver 218 may include a mass port plug 166, 166', as previously described with reference to FIGS. 3, 4, and 5A through 5C. In other embodiments of the present disclosure, the audio driver 218 may comprise any type of audio driver known in the art.

As the port 224 of the driver unit housing 220 opens to the exterior of the ear-cup assembly 202 rather than to a volume of space within the outer ear-cup housing 206, at least one surface 228 of the driver unit housing 220 may be configured to define an exterior surface of the ear-cup assembly 202 of the headphone 200, and the port 224 may extend through the surface 228 of the driver unit housing 220.

Since the acoustical cavity 222 of the driver assembly 216 does not communicate acoustically with any volume of space outside the driver assembly 216 within the outer ear-cup housing 206 of the ear-cup assembly 202, the driver unit housing 220 and the audio driver 218 may be designed and configured together to provide a desirable emitted SPL profile and/or a desirable detectable SPL profile, and the desirable emitted SPL profile and/or desirable detectable SPL profile may be at least substantially independent of the configuration of the ear-cup assembly 202 of the headphone 200 in which the driver assembly 216 is to be installed. As a result, a variety of different configurations and/or sizes of ear-cup assemblies and headphones may be designed and configured to receive a standardized driver assembly 216 having a common configuration therein, and the emitted SPL profile and/or a desirable detectable SPL profile may remain at least substantially the same regardless of the configuration and/or size of the ear-cup assembly 202 in which the driver assembly 216 is installed and employed.

Figure 10:
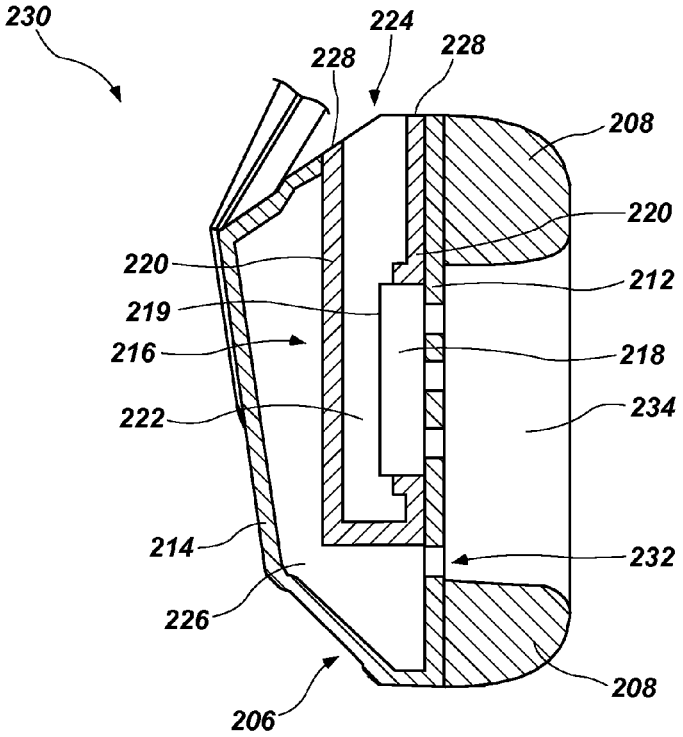
FIG. 10 is a simplified and schematic illustration of a cross-sectional view of another ear-cup assembly that includes a driver assembly in accordance with another embodiment of a headphone of the present disclosure.

FIG. 10 illustrates an additional embodiment of an ear-cup assembly 230, which is similar to the ear-cup assembly 202 of FIGS. 9B and 9C, and which may be employed in a headphone such as the headphone 200 of FIG. 9A, but which includes an aperture or port 232 extending through the front member 212 of the outer ear-cup housing 206 at a location providing communication between a space 234 and the volume of space 226 within the outer ear-cup housing 206 that is outside the audio driver assembly 216. The space 234 is the space that is defined within the cushion 208 between the exterior surface of the front member 212 of the outer ear-cup housing 206 and the head of a person wearing the headphone 200. This space 234 often forms an acoustical cavity in front of the audio driver 218 adjacent the ear of the person wearing the headphone. By providing one or more ports 232 between the space 234 and the volume of space 226 within the outer ear-cup housing 206 that is outside the audio driver assembly 216, and by locating and configuring the one or more ports 232 to have a desirable location, size, and shape, the acoustic response of the audio driver 218 and/or headphone 200 may be selectively tuned over at least a range of frequencies, and thus may be provided with a desirable detectable SPL profile.

Figure 11:
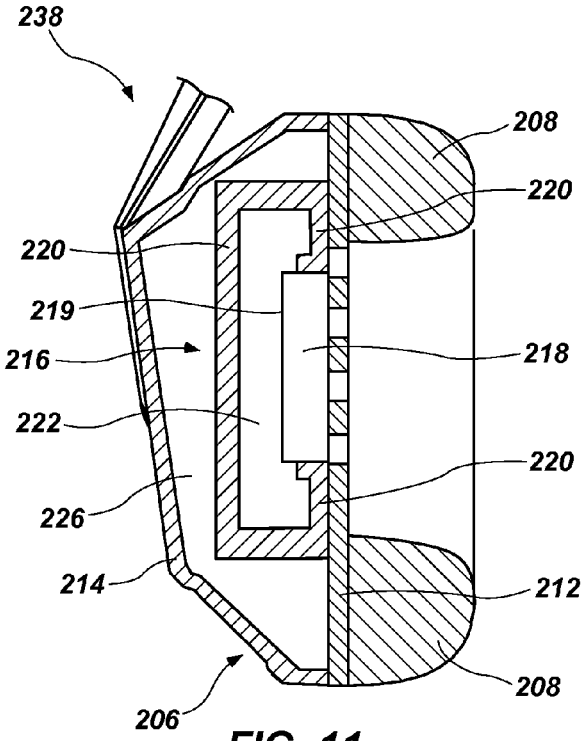
FIG. 11 is a simplified and schematic illustration of a cross-sectional view of another ear-cup assembly that includes a driver assembly in accordance with another embodiment of a headphone of the present disclosure.

FIG. 11 illustrates an additional embodiment of an ear-cup assembly 238, which is similar to the ear-cup assembly 202 of FIGS. 9B and 9C, and which may be employed in a headphone such as the headphone 200 of FIG. 9A, but wherein the audio driver assembly 216 is an enclosed audio driver assembly 216 that does not include a port 224 (FIGS. 9B and 9C). As a result, the acoustical cavity 222 is at least substantially enclosed and sealed within the driver unit housing 220 of the driver assembly 216. By selectively configuring the driver unit housing 220 of the driver assembly 216 and the acoustical cavity 222 defined therein, the acoustic response of the audio driver 218 and/or headphone 200 may be selectively tuned over at least a range of frequencies, and thus may be provided with a desirable detectable SPL profile. In addition, since the acoustical cavity 222 of the driver assembly 216 does not communicate acoustically with any volume of space outside the driver assembly 216 within the outer ear-cup housing 206 or outside the outer ear cup housing 206 of the ear-cup assembly 238, the emitted SPL profile and/or detectable SPL profile of the driver assembly 216 may be at least substantially independent of the configuration of the outer ear-cup housing 206 of the ear-cup assembly 238 of the headphone 200 in which the driver assembly 216 is installed.

As previously mentioned, using mass port plugs 166 as described herein may allow for substantially similar audio drivers 110 to be employed in headphones having different configurations of ear-cup housings, while allowing the headphones to provide selected SPL profiles and without concern to the configuration of acoustical cavities defined within the ear-cup housings. Thus, the mass port plugs 166 may be used by headphone manufacturers to selectively tune the acoustics of headphones, while providing greater freedom in the design of the ear-cup housings in which they are employed.

For example, in manufacturing a plurality of headphones 100, 200, a plurality of at least substantially identical audio drivers 110 as previously described herein may be provided. A first set of mass port plugs 166 may be inserted at least partially into the driver apertures 156 extending through some of the audio drivers 110. Each of the first set of mass port plugs 166 may have an acoustic aperture 168 extending through the mass port plug 166 from a first side thereof to an opposing second side thereof, and the acoustic aperture 168 may be configured to cause the audio drivers 110 to exhibit a first selected detectable SPL profile.

A second set of mass port plugs 166' may be inserted at least partially into the driver apertures 156 extending through others of the audio drivers 110. Each of the second set of mass port plugs 166' may have an acoustic aperture 168' extending through the mass port plug 166' from a first side thereof to an opposing second side thereof, and the acoustic aperture 168' may be configured to cause the audio drivers 110 to exhibit a second selected driver detectable SPL profile. The first set of mass port plugs 166 may have a configuration different from a configuration of the second set of mass port plugs 166', and, as a result, the first selected detectable SPL profile differs from the second selected detectable SPL profile.

The audio drivers 110 then may be attached to ear-cup housings 106, 206 for use in headphones 100, 200. For example, the audio drivers 110 having the first set of mass port plugs 166 may be attached to a first plurality of ear-cup housings 106, and the audio drivers 110 having the second set of mass port plugs 166' may be attached to a second plurality of ear-cup housings 206, which may have a configuration different from a configuration of the first plurality of ear-cup housings 106. A first plurality of headphones 100 may be formed that comprise the first plurality of ear-cup housings 106 and the audio drivers 110 including the first plurality of mass port plugs 166, and a second plurality of headphones 200 may be formed that comprise the second plurality of ear-cup housings 206 and the audio drivers 110 including the second plurality of mass port plugs 166'. The first plurality of headphones 100 may exhibit a third detectable SPL profile, and the second plurality of headphones 200 may exhibit a fourth detectable SPL profile. In some embodiments, the third and fourth detectable SPL profiles exhibited by the headphones 100 and the headphones 200, respectively, may be at least substantially similar to one another, or they may differ from one another.

Additional non-limiting example embodiments of the disclosure are set forth below.

Embodiment 1

A headphone, comprising: an ear-cup housing; an audio driver disposed at least partially within the ear-cup housing, the audio driver including: a driver housing; a diaphragm suspended from the driver housing; one of a magnet and a coil carried on a back side of the diaphragm; and another of the magnet and the coil carried by the driver housing behind the diaphragm, the magnet and coil magnetically coupled with one another such that electrical current flowing through the coil generates a magnetic force acting on the diaphragm through the magnet or coil carried on the back side of the diaphragm; a driver aperture extending through the audio driver from an exterior thereof toward the diaphragm; and a mass port plug disposed at least partially within the driver aperture extending through the audio driver, the mass port plug having an acoustic aperture extending through the mass port plug from a first side thereof to an opposing second side thereof, the acoustic aperture configured to cause the audio driver to exhibit a selected detectable SPL profile.

Embodiment 2

The headphone of Embodiment 1, wherein the magnet has a cylindrical shape, and wherein the mass port plug extends at least partially through an interior space defined by the cylindrical shape of the magnet.

Embodiment 3

The headphone of Embodiment 1 or Embodiment 2, wherein the coil has a cylindrical shape, and wherein the mass port plug extends at least partially through an interior space defined by the cylindrical coil.

Embodiment 4

The headphone of any one of Embodiments 1 through 3, wherein the driver aperture is at least partially defined by surfaces of the driver housing.

Embodiment 5

The headphone of any one of Embodiments 1 through 4, wherein the driver aperture is at least partially defined by surfaces of the magnet.

Embodiment 6

The headphone of any one of Embodiments 1 through 5, wherein the driver aperture is at least partially defined by surfaces of the coil.

Embodiment 7

The headphone of any one of Embodiments 1 through 6, wherein the mass port plug is generally tubular.

Embodiment 8

The headphone of any one of Embodiments 1 through 7, wherein the mass port plug is generally cylindrical.

Embodiment 9

The headphone of any one of Embodiments 1 through 8, wherein the mass port plug includes at least one radially extending flange configured to abut against a surface of the driver housing.

Embodiment 10

A method of fabricating a headphone, comprising: providing an audio driver, including: a driver housing; a diaphragm suspended from the driver housing; one of a magnet and a coil carried by the diaphragm; another of the magnet and the coil carried by the driver housing; and a driver aperture extending through the audio driver from an exterior thereof toward the diaphragm; and inserting a mass port plug at least partially into the driver aperture extending through the audio driver, the mass port plug having an acoustic aperture extending through the mass port plug from a first side thereof to an opposing second side thereof, the acoustic aperture configured to cause the audio driver to exhibit a selected detectable SPL profile; and attaching the audio driver to an ear-cup housing.

Embodiment 11

The method of Embodiment 10, wherein the magnet has a cylindrical shape, and wherein inserting the mass port plug at least partially into the driver aperture comprises inserting the mass port plug at least partially into an interior space defined by the cylindrical shape of the magnet.

Embodiment 12

The method of Embodiment 10 or Embodiment 11, wherein the coil has a cylindrical shape, and wherein inserting the mass port plug at least partially into the driver aperture comprises inserting the mass port plug at least partially into an interior space defined by the cylindrical shape of the coil.

Embodiment 13

The method of any one of Embodiments 10 through 12, further comprising selecting the mass port plug to comprise a generally tubular mass port plug.

Embodiment 14

The method of any one of Embodiments 10 through 13, further comprising selecting the mass port plug to comprise a generally cylindrical mass port plug.

Embodiment 15

The method of any one of Embodiments 10 through 14, wherein the mass port plug includes at least one radially extending flange, and wherein the method further includes abutting the at least one radially extending flange of the mass port plug against a surface of the driver housing.

Embodiment 16

The method of any one of Embodiments 10 through 15, further comprising fabricating the mass port plug.

Embodiment 17

The method of any one of Embodiments 10 through 16, wherein attaching the audio driver to the ear-cup housing comprises attaching the audio driver to a ear-cup housing defining an acoustical cavity therein adjacent the diaphragm, the mass port plug acoustically coupling the exterior of the audio driver with the acoustical cavity defined within the driver housing.

Embodiment 18

A method of fabricating a plurality of headphones, comprising: providing a plurality of at least substantially identical audio drivers, each audio driver including: a driver housing; a diaphragm suspended from the driver housing; one of a magnet and a coil carried by the diaphragm; another of the magnet and the coil carried by the driver housing; and a driver aperture extending through the audio driver from an exterior thereof toward the diaphragm; inserting mass port plugs of a first plurality of mass port plugs at least partially into the driver apertures extending through some of the audio drivers, each mass port plug of the first plurality having an acoustic aperture extending through the mass port plug from a first side thereof to an opposing second side thereof, the acoustic aperture configured to cause the audio drivers to exhibit a first selected detectable SPL profile; inserting mass port plugs of a second plurality of mass port plugs at least partially into the driver apertures extending through others of the audio drivers, each mass port plug of the second plurality having an acoustic aperture extending through the mass port plug from a first side thereof to an opposing second side thereof, the acoustic aperture configured to cause the audio drivers to exhibit a second selected driver detectable SPL profile, wherein the mass port plugs of the first plurality of mass port plugs have a configuration different from a configuration of the mass port plugs of the second plurality of mass port plugs; and attaching the audio drivers to ear-cup housings.

Embodiment 19

The method of Embodiment 18, wherein the first selected detectable SPL profile differs from the second selected detectable SPL profile.

Embodiment 20

The method of Embodiment 18 or Embodiment 19, wherein the audio drivers having the mass port plugs of the first plurality are attached to a first plurality of ear-cup housings, and wherein the audio drivers having the mass port plugs of the second plurality are attached to a second plurality of ear-cup housings having a configuration different from a configuration of the first plurality of ear-cup housings.

Embodiment 21

The method of Embodiment 20, further comprising: forming a first plurality of headphones comprising the first plurality of ear-cup housings and the audio drivers including the first plurality of mass port plugs, the first plurality of headphones exhibiting a third detectable SPL profile, and forming a second plurality of headphones comprising the second plurality of ear-cup housings and the audio drivers including the second plurality of mass port plugs, the second plurality of headphones exhibiting a fourth detectable SPL profile at least substantially similar to the third detectable SPL profile.

The embodiments of the invention described above do not limit the scope of the invention, since these embodiments are merely examples of embodiments of the invention, which is defined by the scope of the appended claims and their legal equivalents. Any equivalent embodiments are intended to be within the scope of this invention. Indeed, various modifications of the disclosed embodiments, such as alternative useful combinations of the described elements of the embodiments, will become apparent to those skilled in the art from the description. Such modifications are also intended to fall within the scope of the appended claims.

What is claimed is:

1. A method of fabricating a plurality of headphones, comprising:

providing a plurality of at least substantially identical audio drivers, each audio driver including:

a driver housing;

a diaphragm suspended from the driver housing;

one of a magnet and a coil carried on a back side of the diaphragm;

another of the magnet and the coil carried by the driver housing behind the diaphragm, the magnet and coil magnetically coupled with one another such that electrical current flowing through the coil generates a magnetic force acting on the diaphragm through the magnet or coil carried on the back side of the diaphragm; and a driver aperture extending through the driver housing, sidewalls of at least one of the driver housing, the magnet, or the coil defining the driver aperture extending from an exterior of the driver housing toward the diaphragm;

inserting mass port plugs of a first plurality of mass port plugs at least partially into the driver apertures extending through some of the driver housings, each mass port plug of the first plurality having an acoustic aperture extending through the mass port plug from a first side thereof to an opposing second side thereof, the acoustic aperture configured to cause the audio drivers to exhibit a first selected detectable sound pressure level (SPL) profile;

inserting mass port plugs of a second plurality of mass port plugs at least partially into the driver apertures extending through others of the driver housings, each mass port plug of the second plurality having an acoustic aperture extending through the mass port plug from a first side thereof to an opposing second side thereof, the acoustic aperture configured to cause the audio drivers to exhibit a second selected driver detectable SPL profile, wherein the mass port plugs of the first plurality of mass port plugs have a configuration different from a configuration of the mass port plugs of the second plurality of mass port plugs; and attaching the audio drivers to ear-cup housings, the audio drivers located at least partially within the ear-cup housings.

2. The method of claim 1, further comprising selecting the first selected detectable SPL profile to differ from the second selected detectable SPL profile.

3. The method of claim 1, wherein the audio drivers having the mass port plugs of the first plurality are attached to a first plurality of ear-cup housings, and wherein the audio drivers having the mass port plugs of the second plurality are attached to a second plurality of ear-cup housings having a configuration different from a configuration of the first plurality of ear-cup housings.

4. The method of claim 3, further comprising:

forming a first plurality of headphones comprising the first plurality of ear-cup housings and the audio drivers including the first plurality of mass port plugs, the first plurality of headphones exhibiting a third detectable SPL profile, and forming a second plurality of headphones comprising the second plurality of ear-cup housings and the audio drivers including the second plurality of mass port plugs, the second plurality of headphones exhibiting a fourth detectable SPL profile at least substantially similar to the third detectable SPL profile.

5. A headphone, comprising:

an ear-cup housing;

an audio driver disposed at least partially within the ear-cup housing, the audio driver including:

a driver housing;

a diaphragm suspended from the driver housing;

one of a magnet and a coil carried on a back side of the diaphragm;

another of the magnet and the coil carried by the driver housing behind the diaphragm, the magnet and coil magnetically coupled with one another such that electrical current flowing through the coil generates a magnetic force acting on the diaphragm through the magnet or coil carried on the back side of the diaphragm;

a driver aperture extending through the driver housing, sidewalls of at least one of the driver housing, the magnet, or the coil defining the driver aperture extending from an exterior of the driver housing toward the diaphragm; and a mass port plug disposed at least partially within the driver aperture extending through the driver housing, the mass port plug having an acoustic aperture extending through the mass port plug from a first side thereof to an opposing second side thereof, the acoustic aperture configured to cause the audio driver to exhibit a selected detectable sound pressure level (SPL) profile.

6. The headphone of claim 5, wherein the magnet has a cylindrical shape, and wherein the mass port plug extends at least partially through an interior space defined by the cylindrical shape of the magnet.

7. The headphone of claim 5, wherein the coil has a cylindrical shape, and wherein the mass port plug extends at least partially through an interior space defined by the cylindrical coil.

8. The headphone of claim 5, wherein the driver aperture is at least partially defined by surfaces of the driver housing.

9. The headphone of claim 5, wherein the driver aperture is at least partially defined by surfaces of the magnet.

10. The headphone of claim 5, wherein the driver aperture is at least partially defined by surfaces of the coil.

11. The headphone of claim 5, wherein the mass port plug is generally tubular.

12. The headphone of claim 11, wherein the mass port plug is generally cylindrical.

13. The headphone of claim 11, wherein the mass port plug includes at least one radially extending flange configured to abut against a surface of the driver housing.

14. A method of fabricating a headphone, comprising:

providing an audio driver, including:

a driver housing;

a diaphragm suspended from the driver housing;

one of a magnet and a coil carried on a back side of the diaphragm;

another of the magnet and the coil carried by the driver housing behind the diaphragm, the magnet and coil magnetically coupled with one another such that electrical current flowing through the coil generates a magnetic force acting on the diaphragm through the magnet or coil carried on the back side of the diaphragm; and a driver aperture extending through the driver housing, sidewalls of at least one of the driver housing, the magnet, or the coil defining the driver aperture extending from an exterior of the driver housing, toward the diaphragm; and inserting a mass port plug at least partially into the driver aperture extending through the driver housing, the mass port plug having an acoustic aperture extending through the mass port plug from a first side thereof to an opposing second side thereof, the acoustic aperture configured to cause the audio driver to exhibit a selected detectable SPL profile; and attaching the audio driver to an ear-cup housing, the audio driver located at least partially within the ear-cup housing.

15. The method of claim 14, wherein the magnet has a cylindrical shape, and wherein inserting the mass port plug at least partially into the driver aperture comprises inserting the mass port plug at least partially into an interior space defined by the cylindrical shape of the magnet.

16. The method of claim 14, wherein the coil has a cylindrical shape, and wherein inserting the mass port plug at least partially into the driver aperture comprises inserting the mass port plug at least partially into an interior space defined by the cylindrical shape of the coil.

17. The method of claim 14, further comprising selecting the mass port plug to comprise a generally tubular mass port plug.

18. The method of claim 17, wherein the mass port plug includes at least one radially extending flange, and wherein the method further includes abutting the at least one radially extending flange of the mass port plug against a surface of the driver housing.

19. The method of claim 14, further comprising fabricating the mass port plug.

20. The method of claim 14, wherein attaching the audio driver to the ear-cup housing comprises attaching the audio driver to a driver housing defining an acoustical cavity therein adjacent the diaphragm, the mass port plug acoustically coupling the exterior of the audio driver with the acoustical cavity defined within the ear-cup housing.

* * * * *